United States Patent [19]

Kulle et al.

[11] 4,235,344

[45] Nov. 25, 1980

[54] IRRIGATION CAP

[75] Inventors: Lee K. Kulle, Mundelein; William L. Rudzena, McHenry, both of Ill.

[73] Assignee: Baxter Travenol Laboratories, Inc., Deerfield, Ill.

[21] Appl. No.: 7,488

[22] Filed: Jan. 29, 1979

[51] Int. Cl.[3] ..... B65D 41/20

[52] U.S. Cl. ..... 215/250; 215/308

[58] Field of Search ..... 215/248, 247, 249, 250, 215/DIG. 3, 308, 309; 150/8; 128/272, 214 R, 214 C

[56] References Cited

U.S. PATENT DOCUMENTS

| | | | |
|---|---|---|---|
| 2,186,908 | 1/1940 | Page | 215/248 |
| 2,812,117 | 11/1957 | Butkus | 215/DIG. 3 |
| 3,293,773 | 12/1966 | Frazer | 215/309 UX |
| 3,734,098 | 5/1973 | Schneller | 128/272 |
| 3,746,001 | 7/1973 | Ralston | 128/214 D |
| 3,945,382 | 3/1976 | Ogle | 128/272 |
| 4,046,276 | 9/1977 | Winchell | 150/8 X |

FOREIGN PATENT DOCUMENTS 2360479 3/1978 France .

*Primary Examiner*—Donald F. Norton

*Attorney, Agent, or Firm*—John P. Kirby, Jr.; Paul C. Flattery; George Gerstman

[57] ABSTRACT

An internally threaded dispensing closure for an externally threaded pharmaceutical container having a pour lip. The top surface of the closure defines a first opening surrounded by an upwardly extending port having a membrane therewithin. The spike of an administration set or the like may be inserted into the port to pierce the membrane. The top surface of the closure also defines a second opening having a hydrophobic filter communicating with the air above the top portion and also below the top portion. A gasket is carried by the underside of the top portion for sealing engagement with the pour lip of the container.

6 Claims, 2 Drawing Figures

IRRIGATION CAP

BACKGROUND OF THE INVENTION

This invention concerns a removable dispensing closure for closing an externally threaded container having a pour lip, and, more particularly, to an irrigation closure assembly for a pharmaceutical container.

Pharmaceutical containers often have an externally threaded neck to which an internally threaded closure is connected, with the nurse or operator having the ability to remove the closure and pour the contents of the container directly from the pour lip. It is often desired to couple an administration set or the like to the pharmaceutical container by means of a spike carried by the administration set. To this end, a closure is generally provided having a port for receiving the spike of the administration set.

It is desirable that the original closure of the container have the ability for removal thereof, allowing pouring of the contents through the pour lip of the container and also have the ability to couple the spike of the administration set thereto, if desired. It is also desirable that the closure of the container be relatively simple in construction and efficient to manufacture.

Therefore, it is an object of the present invention to provide a dispensing closure for closing an externally threaded container having a pour lip, with the dispensing closure being entirely removable and, alternatively, having the ability to receive the spike from an administration set.

A further object of the present invention is to provide a dispensing closure that may be molded from plastic and is autoclavable.

A further object of the invention is to provide an irrigation set assembly that is simple in construction and efficient to manufacture.

A still further object of the invention is to provide a dispensing closure that has a good sealing engagement with the pour lip of the container when the dispensing closure is threaded onto the container.

Another object of the present invention is to provide an irrigation set assembly to which a spike may be connected, with a hydrophobic filter carried thereby for providing proper air flow.

Other objects and advantages of the present invention will become apparent as the description proceeds.

SUMMARY OF THE INVENTION

In accordance with the present invention, a dispensing closure is provided for closing an externally threaded container having a pour lip. The dispensing closure has a top portion with an annular internally threaded skirt depending downwardly therefrom.

The improvement comprises the top surface defining a first opening surrounded by an upwardly extending port adapted for receiving a spike within the walls of the port. A membrane seals the port and lies in a plane above the plane of the top portion. The membrane is adapted for piercing by the spike when the spike is inserted into the port.

The top surface defines a second opening with a hydrophobic filter positioned to close the second opening and to be in communication on one side with the volume below the top portion and on the other side with the air above the top portion. Means are carried by the underside of the top portion for sealing engagement with the pour lip of the container.

In the illustrative embodiment, an annular collar surrounds the second opening and extends downwardly therefrom. Means are provided within the annular collar for providing a seat for the hydrophobic filter.

In the illustrative embodiment, an axially oriented ring extends downwardly from the top portion with the external diameter of the ring being smaller than the internal diameter of the pour lip of the container. Sealing means comprises a gasket snugly surrounding the ring.

A more detailed explanation of the invention is provided in the following description and claims, and is illustrated in the accompanying drawings.

DETAILED DESCRIPTION OF THE ILLUSTRATIVE EMBODIMENT

Figure 1:
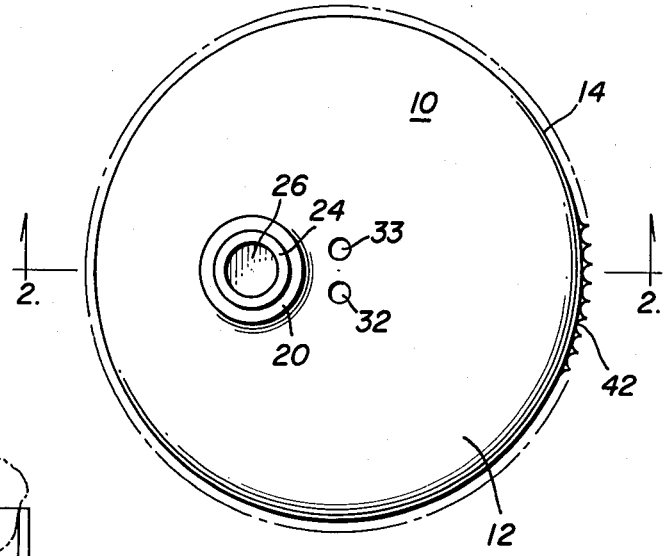
FIG. 1 is a top plan view of a dispensing closure constructed in accordance with the principles of the present invention.
Figure 2:
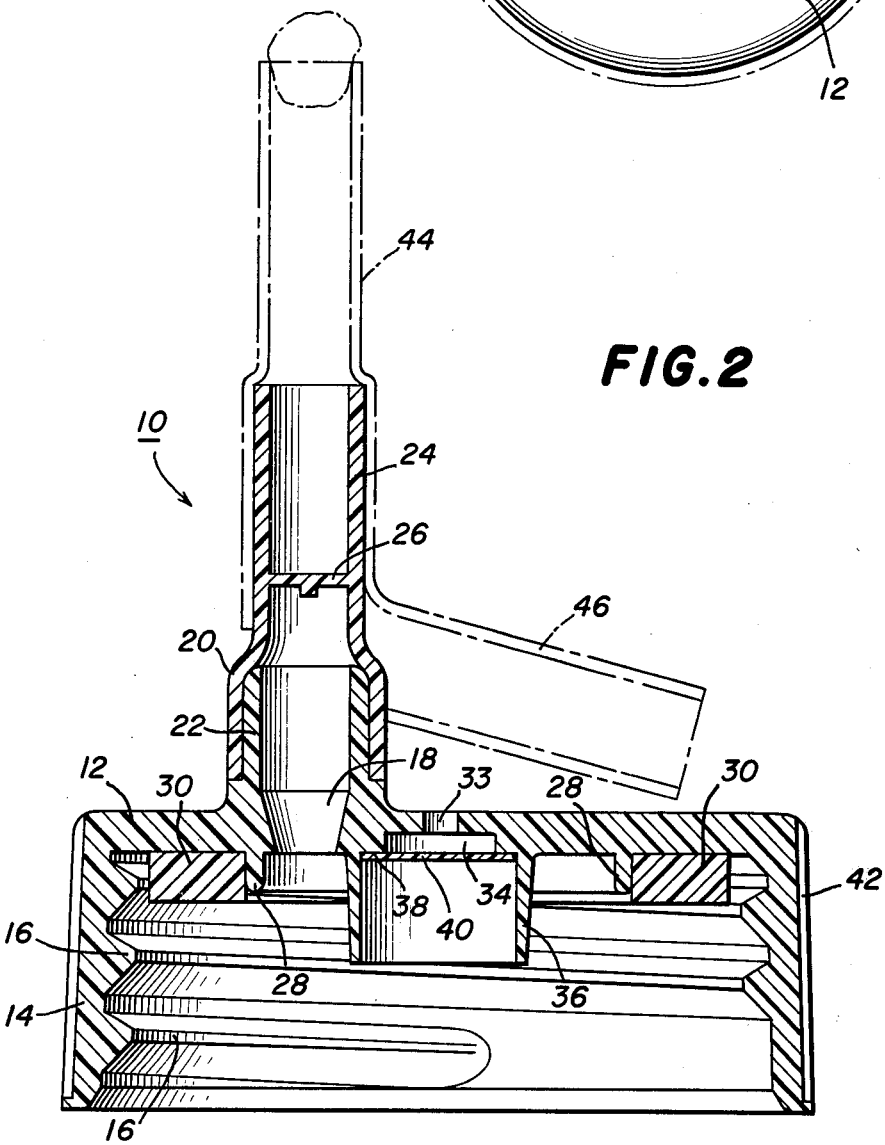
FIG. 2 is a cross-sectional elevation thereof, taken along the plane of the line 2—2 of FIG. 1.

Referring to the drawings, irrigation cap assembly 10 is shown therein, comprising a dispensing closure formed of a top portion 12 having a downwardly depending annular skirt 14 extending therefrom. Skirt 14 defines internal threads 16 which engage the external threads of a pharmaceutical container.

Top surface 12 defines a first opening 18 which is surrounded by an upwardly extending port 20. Port 20 comprises a first port portion 22 which is molded integrally with top portion 12 and skirt 14 and a tubular member 24 which is bonded to port portion 22. Tubular member 24 has an internal diameter that is equal to or slightly greater than the external diameter of a spike which may be inserted into the tubular member 24. A piercable membrane 26 closes the tubular member 24 until the membrane 26 is pierced by the spike, in order to maintain the contents of the container free from contamination.

An annular ring 28 extends downwardly from top portion 12 and is formed integrally therewith and a gasket 30, formed of silicone rubber or the like, snugly surrounds annular ring 28. Gasket 30 is adapted for sealing engagement with the pour lip of the container, to prevent the container contents from spilling onto the container threads.

Top portion 12 also defines a pair of openings 32, 33 which communicate with the main opening 34 also defined by the top portion 12. An annular collar 36 extends downwardly from the top portion and surrounds the openings 32, 33, 34 and forms an annular filter seat 38 onto which a hydrophobic filter 40 is positioned. Hydrophobic filter 40 and openings 32–34 serve as an airway passage for proper flow during the irrigation process.

For ease in grasping, it is preferred that skirt 14 carry vertical ribs 42 about its circumference. A removable tip protector 44 may be provided for providing a dust seal over port 20. Just prior to insertion of the spike into the tubular member 24, the tip protector 44 is removed by grasping portion 46 and pulling it upwardly.

It is preferred that the cap be formed of an autoclavable plastic material and have an integrally molded one-piece construction including the top portion 12, interally threaded skirt 14, first port portion 22, annular ring 28, and annular collar 36. Gasket 30 and the hydrophobic filter 40 may be attached subsequently.

It can be seen that simple yet effective closure has been provided for an externally threaded container, enabling the closure to be removable if the contained solution must be poured quickly from the container, but also enabling the spike of an administration set to be directly connected to the upwardly extending port. The closure is such that it provides proper venting and fluid flow and also provides an effective sealing engagement with the pour lip of the container when the closure is threaded closed on the container.

Although an illustrative embodiment of the invention has been shown and described, it is to be understood that various modifications and substitutions may be made by those skilled in the art without departing from the novel spirit and scope of the present invention.

That which is claimed is:

1. A dispensing closure for closing an externally threaded container having a pour lip, the dispensing closure having a top portion with an annular internally threaded skirt depending downwardly therefrom, the improvement comprising, in combination:

said top portion defining a first opening surrounded by an upwardly-extending port adapted for receiving a spike within walls of the port; a membrane sealling the port and lying in a plane above the plane of the top portion, the membrane being adapted for piercing by the spike when the spike is inserted into the port;

said top portion defining a second opening with a hydrophobic filter positioned to close said second opening and be in communication on one side with the volume below said top portion and on the other side with the air above the top portion; a filter seat for seating said hydrophobic filter; and means carried by the underside of the top portion for sealing engagement with the pour lip of the container.

2. A dispensing closure as described in claim 1, including an annular collar surrounding said second opening and extending downwardly therefrom, and means within said annular collar providing said seat for said hydrophobic filter.

3. A dispensing closure as described in claim 1, including an axially-oriented ring extending downwardly from said top portion with the external diameter of the ring being smaller than the internal diameter of the pour lip of the bottle; said sealing means comprising a gasket snugly surrounding said ring for sealing engagement with the pour lip.

4. A dispensing closure as described in claim 1, said second opening comprising a pair of spaced openings defined by the top portion; said filter seat being located adjacent said spaced openings for seating said hydrophobic filter.

5. A dispensing closure for closing an externally threaded container having a pour lip, the dispensing closure having a top portion with an annular internally threaded skirt depending downwardly therefrom, the improvement comprising, in combination:

said top portion defining a first opening surrounded by an upwardly extending port adapted for receiving a spike within the walls of the port; a membrane sealing the port and lying in a plane above the plane of the top portion, the membrane being adapted for piercing by the spike when the spike is inserted into the port;

said top portion difining a second opening with a hydrophobic filter positioned to close said second opening and be in communication on one side with the volume below the top portion and on the other side with the air above the top portion, said second opening comprising a pair of spaced openings defined by the top portion;

a filter seat adjacent said spaced openings for seating said hydrophobic filter;

an annular collar surrounding said second opening and extending downwardly therefrom;

an axially-oriented ring extending downwardly from said top portion with the external diameter of the ring being smaller than the internal diameter of the pour lip of the container; and a gasket snugly surrounding said ring for sealing engagement with said pour lip.

6. A dispensing closure as described in claim 5, said upwardly extending port comprising a first port portion molded integrally with the top portion and skirt, and a second rigid tubular member bonded to the first port portion and including the membrane therewithin.

* * * * *